United States Patent [19]

Marra

[11] 4,164,991

[45] Aug. 21, 1979

[54] FIRE ESCAPE DEVICE

[76] Inventor: Aldo Marra, 11 Wood St., San Francisco, Calif. 94118

[21] Appl. No.: 892,759

[22] Filed: Apr. 3, 1978

[51] Int. Cl.[2] ..... E06C 9/14; E06C 1/36; E06C 1/56

[52] U.S. Cl. ..... 182/70; 182/129; 182/196; 182/206

[58] Field of Search ..... 182/70–76, 182/196–199, 206, 150, 120, 121, 129; 248/215, 214, 208, 48.2, 300, 311.1

[56] References Cited

U.S. PATENT DOCUMENTS

| | | | |
|---|---|---|---|
| 373,472 | 11/1887 | Moser | 248/214 |
| 950,361 | 2/1910 | Woods | 248/214 |
| 1,307,211 | 6/1919 | Newlon | 248/214 |
| 1,426,787 | 8/1922 | Spencer | 248/214 |
| 1,753,798 | 4/1930 | Martin | 182/70 |
| 3,075,612 | 1/1963 | Gould | 182/206 |
| 3,309,053 | 3/1967 | Baker | 248/214 |
| 3,344,886 | 10/1967 | Boscarino | 182/70 |

*Primary Examiner*—Reinaldo P. Machado
*Attorney, Agent, or Firm*—Lothrop & West

[57] ABSTRACT

A fire escape device has a box with a back panel secured to side panels and to two bottom end panels. A bottom central panel lies between the bottom end panels and is hinged to the back panel. A front panel is hinged to the bottom central panel and has a bottom edge rabbet interfitting with the front edge of the bottom end panels. A removable top panel has angles engaging the upper edges of the back panel and of the front panel and is short to leave end openings above the bottom end panels through which ornaments on the bottom end panels may project. The box is secured to a building by brackets secured to the back panel and the two bottom end panels. Brackets of one design lie over a balcony rail, and brackets of another design are bolted to the building wall. A ladder including side chains and cross rungs is disposed on the bottom central panel with the chains extending through cutouts in the top panel. Weight on the ladder is transmitted through quick screw links passing through holes in the brackets or alternatively to an extensible rod adapted to rest on the top panel and to be moved through a building window and then extended to engage the inside frame of the window.

7 Claims, 10 Drawing Figures

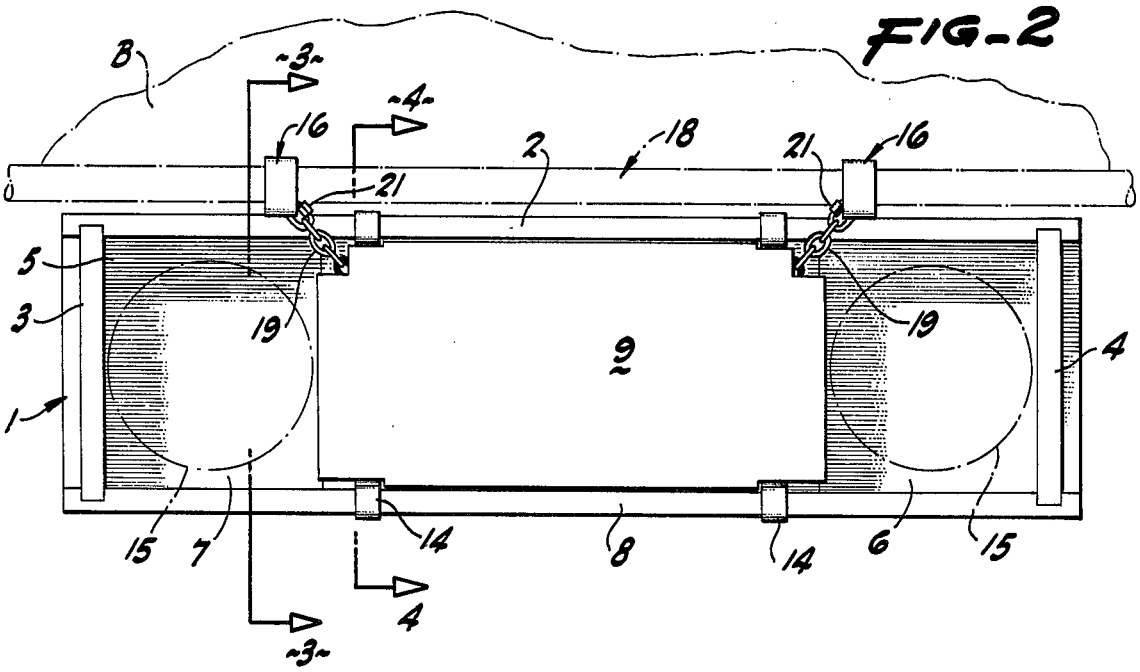
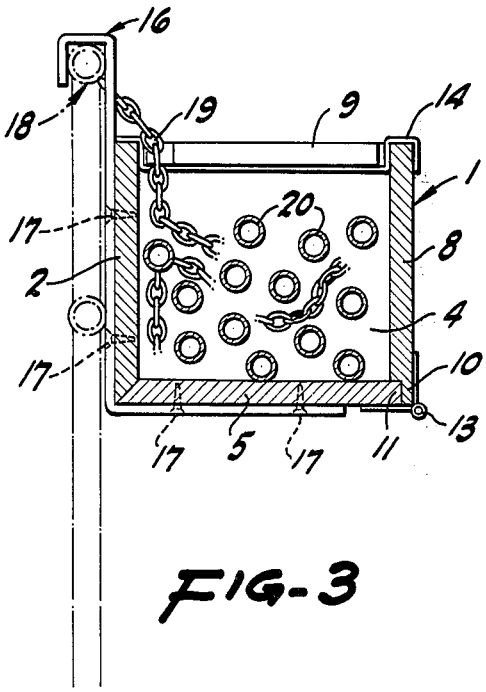
FIG-3
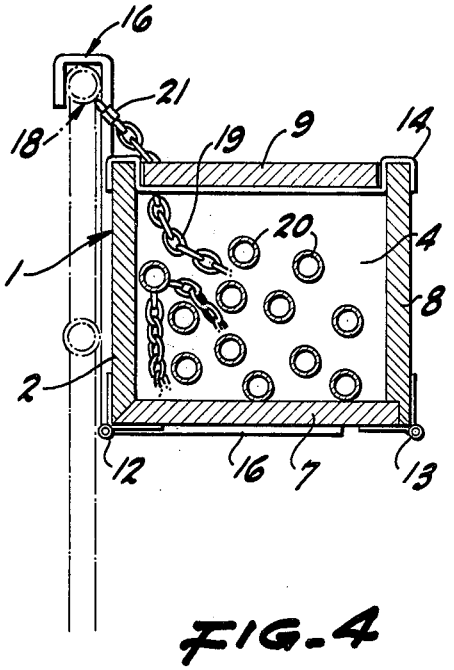
FIG-4
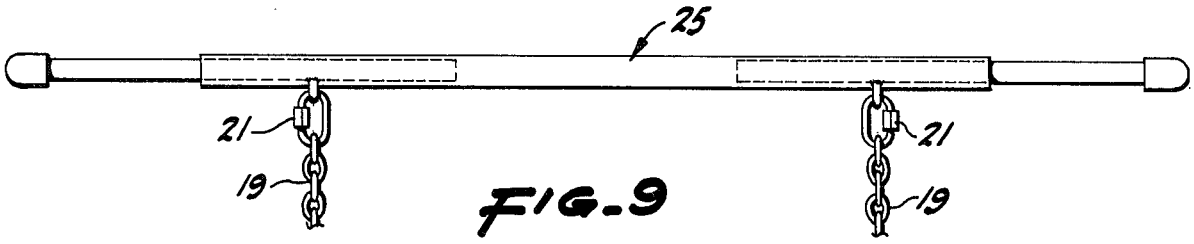
FIG-9

FIG-5
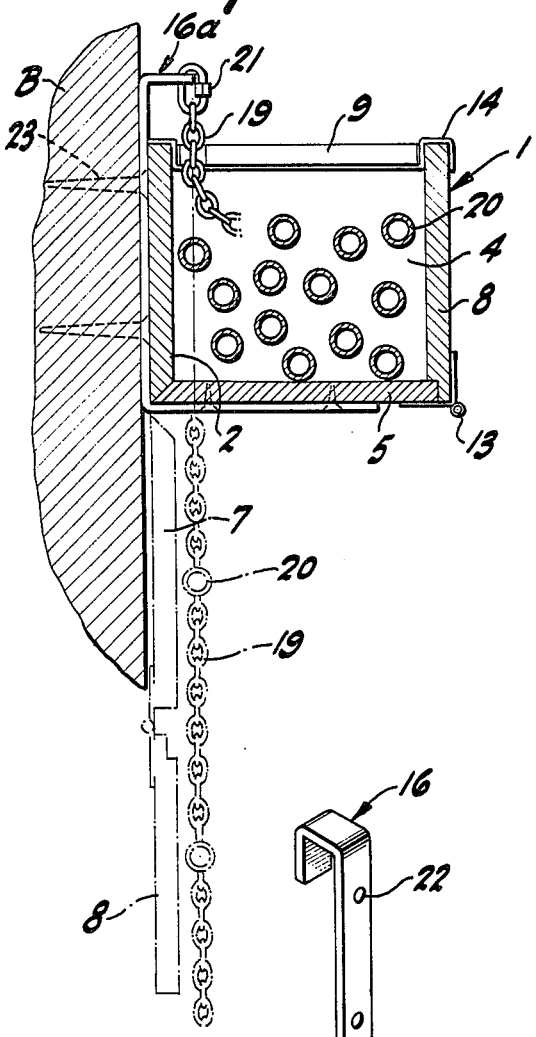
FIG-6
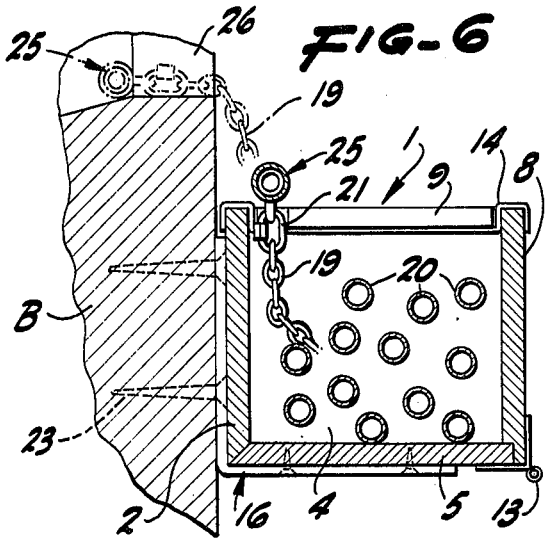
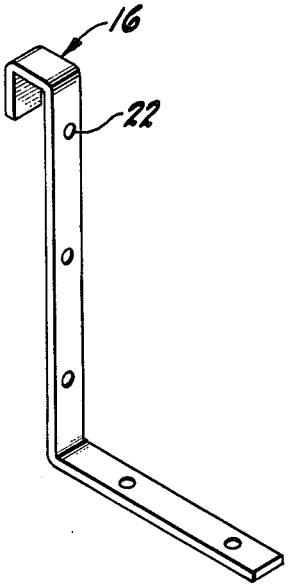
FIG-7
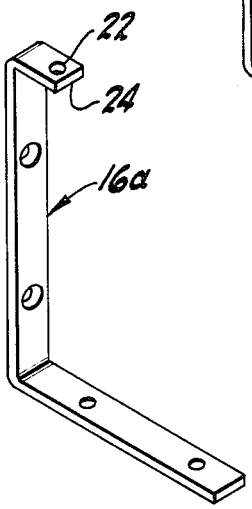
FIG-8
FIG-10
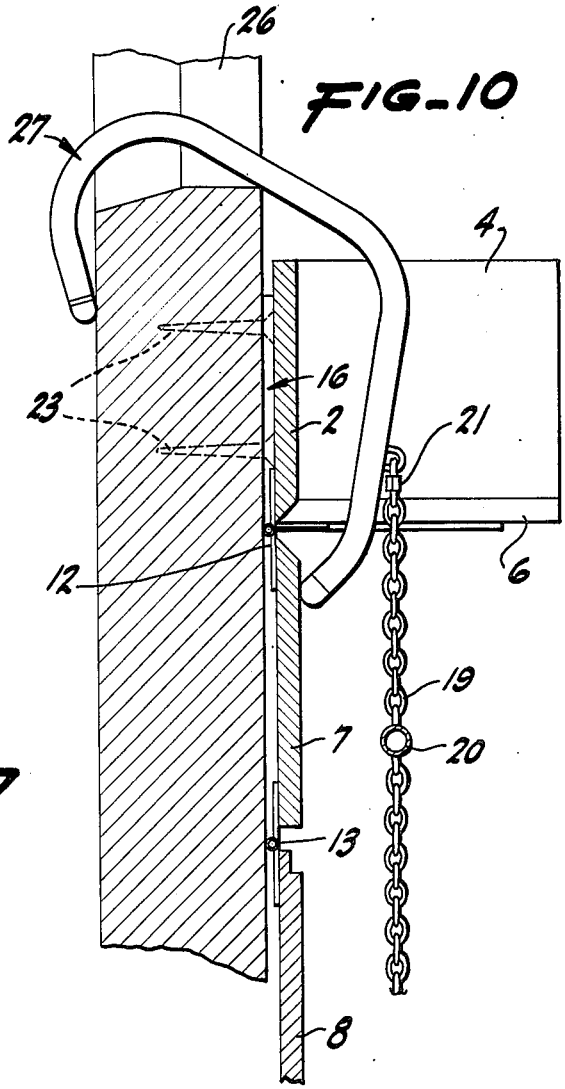

FIRE ESCAPE DEVICE

BRIEF SUMMARY OF THE INVENTION

The usual fire escape construction or a permanent installation of the usual sort is generally unsightly, may interfere with other portions of the building, and consequently is disadvantageous. The difficulties are overcome by an attractive arrangement, like the customarily employed planter or flower box, supported on the building and having within it a compartment to receive a folding or extensible fire ladder including side chains and rungs and directly or indirectly supported by the building. Upon occurrence of a fire, panels of the box are moved to an extraordinary, emergency position, thus releasing a portion of the contained fire ladder for use by a person leaving the building. The device is not only attractive and easily installed, but is effective in emergency.

BRIEF DESCRIPTION OF THE SEVERAL VIEWS OF THE DRAWINGS

FIG. 2 is a top plan view of the fire escape device in normal position and use.

FIG. 3 is a cross-section, the plane of which is indicated by the line 3—3 of FIG. 2.

FIG. 4 is a cross-section, the plane of which is indicated by the line 4—4 of FIG. 2.

FIG. 5 is a cross-section, comparable to FIG. 3 but showing a different bracket.

FIG. 6 is a cross-section like FIG. 3 but showing an extensible rod for the ladder chains.

FIG. 7 is an isometric perspective view of one design of bracket.

FIG. 8 is an isometric perspective view of another design of bracket.

FIG. 9 is an isometric perspective view of an extensible rod.

FIG. 10 is a cross-section like FIG. 3 but showing a different device for interengaging the ladder and building.

DETAILED DESCRIPTION

Figure 1:
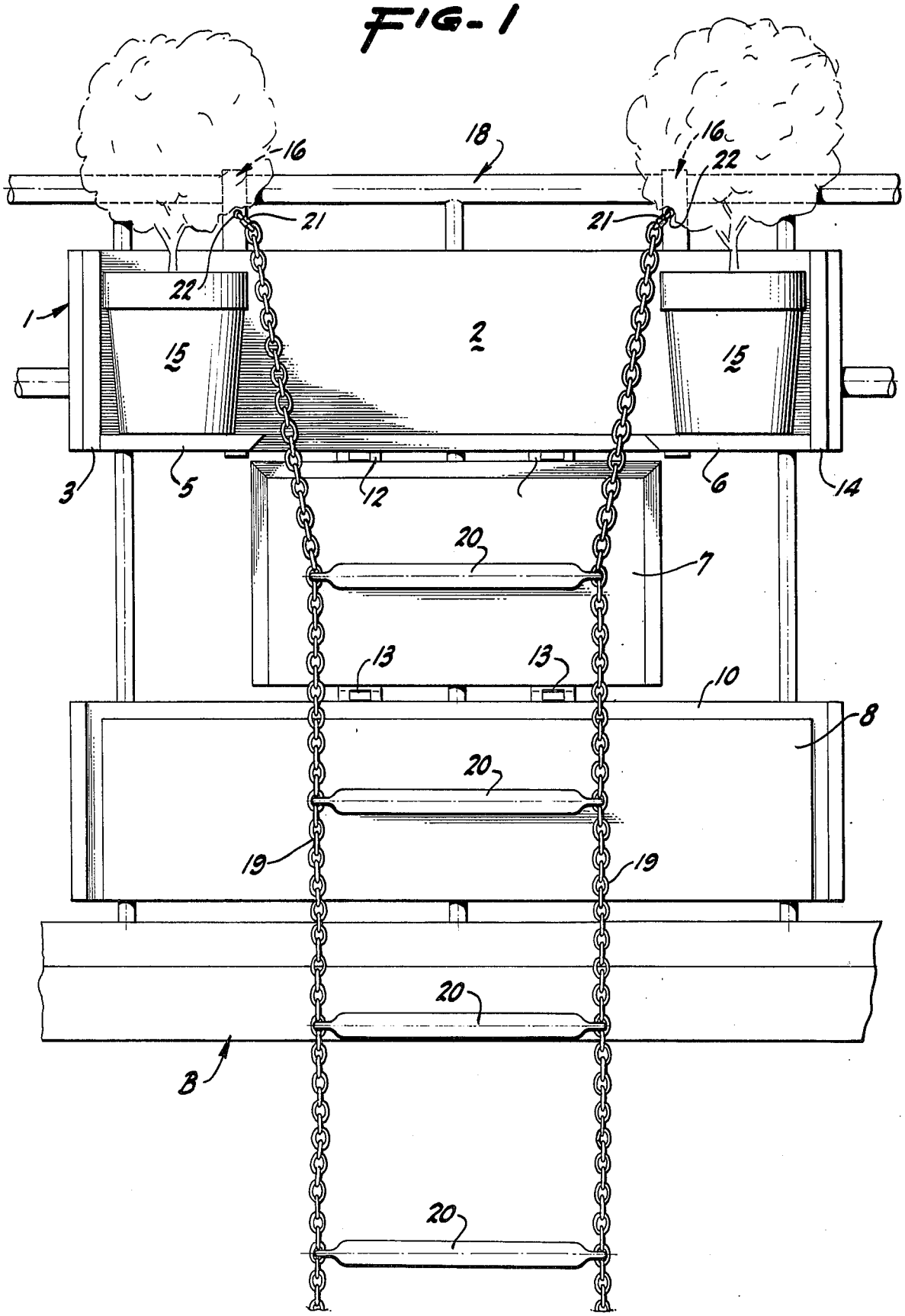
FIG. 1 is a front elevation of the fire escape device shown in operating position for escape.

My fire escape device is a rectangular box 1 having a back panel 2, a pair of side panels 3 and 4, a pair of bottom end panels 5 and 6, a bottom central panel 7, a front panel 8, and a top panel 9 (FIG. 2). The back panel 2, the side panels 3 and 4 and the bottom end panels 5 and 6 are fixed together by any suitable means. The front panel 8 has a rabbet 10 or groove along the lower edge adapted to interengage the forward edge 11 of both of the bottom end panels 5 and 6. The bottom central panel 7 is connected to the back panel 2 by a pair of hinges 12, and the front panel 8 is connected to the bottom central panel 7 by a pair of hinges 13. The loose top panel 9 has flanges 14 to engage the top edges of the back panel 2 and the front panel 8 and is short to leave spaces for decorative items such as plants 15 supported on the bottom end panels 5 and 6 and rising above the box 1.

The box 1 is supported on a building B in any of various ways. As indicated in FIG. 3, paired brackets 16 of one design are spaced apart to lie on opposite sides of or clear the bottom central panel 7. The brackets 16, detailed in FIG. 7, have portions against and secured to the back panel 2 and the two bottom panels 5 and 6 by screws 17. The brackets 16 hang over a wrought iron rail 18 itself secured to or forming part of the building B.

Normally folded inside the box 1 and resting on the bottom central panel 7 is a commercial, collapsible ladder including side chains 19 and rungs 20. The end links of the chains are engaged by quick screw links 21 also passing through holes 22 in the brackets 16. The chains 19 pass through end cut-outs in the top panel 9 and converge into the box 1 over or near the facing edges of the bottom end panels 5 and 6.

As shown in FIG. 8, brackets **16*a* of a modified design are fastened to the building by suitable bolts 23 and have projecting ends 24 or legs provided with holes 22 for the ladder chain links 21. The legs of the brackets 16*a*** are parallel, the shorter one overlying the longer one.

As shown in FIG. 9, the chains 19 are appropriately secured to a telescoping rod 25 that normally is in a short position and lies atop the panel 9.

In the event of fire, the user first lifts, removes and sets aside the top panel 9, thus removing the flanges. The front panel 8 is then free to be thrust outwardly at the top to disengage the supporting rabbet 10 from the edge 11 of the bottom end panels 5 and 6. The front panel 8, being thus vertically released, swings farther downwardly about the hinges 13, and the weight of part of the ladder assists in swinging the released bottom central panel 7 by gravity about the hinges 12, thus dropping the panels 8 and 7, which hang down by gravity and let the unsecured end portion of the ladder drape over or close to the facing edges of the bottom end panels 5 and 6 and fall completely down free for use.

In the case of the FIG. 6 device, the box 1 is mounted in any convenient way, preferably as previously described. For use, the rod 25 is lifted off of the box and, with a portion of the chains, is pulled in through a window opening 26 in the building B. The rod is then extended in length and placed against the interior of the window frame. The top panel 9 is removed, as before, and the front panel 8 and the bottom central panel 7 are released and dropped as previously described. This permits the remaining portion of the chains 19 and rungs 20 to drop by gravity for use.

In the device shown in FIG. 10, the arrangement is somewhat similar to that of FIG. 6, except that grapples 27 of C-shaped contour are fastened to the chains 19 and preferably are of an extent normally to fit within the box 1. The grapples are designed to go through a window opening 26 and to engage the window frame in supporting relationship.

In all cases, the parts can be restored to initial position for reuse by a substantially reversed sequence.

I claim:

1. A fire escape device for a building comprising a box having a back panel, a pair of bottom end panels fixed to said back panel, a bottom central panel, first hinges connecting said bottom central panel to said back panel, a front panel, second hinges connecting said front panel to said bottom central panel, means supporting said front panel on said bottom end panels and for releasing said front panel from said bottom end panels by outward swinging of said front panel about said second hinges, a top panel adapted to interengage the top of said back panel and the top of said front panel, a ladder of chains and rungs adapted to be disposed largely within said box on said bottom central panel, and means associated with said box for transferring weight from said chains to said building.

2. A device as in claim 1 in which said transferring means includes brackets engaging said box and said building and means for securing said chains to said brackets.

3. A device as in claim 1 in which said transferring means includes an expansible rod.

4. A device as in claim 1 in which said transferring means includes a grapple.

5. A device as in claim 1 in which said top panel is shorter than said box to leave end spaces through which decorative items on said bottom end panels may project above said box.

6. A device as in claim 1 in which said brackets are spaced apart farther than the facing edges of said bottom end panels and said chains in use approach or bear against said facing edges.

7. A device as in claim 1 including a pair of side panels fixed to said base panel and to said pair of bottom end panels.

* * * * *